US006713565B2

(12) United States Patent
Burkhart et al.

(10) Patent No.: US 6,713,565 B2
(45) Date of Patent: Mar. 30, 2004

(54) GOLF BALL

(75) Inventors: Craig William Burkhart, Chagrin Falls, OH (US); Michael Lester Kerns, Medina, OH (US); Kenneth Floyd Castner, Uniontown, OH (US); Michael Joseph Rachita, North Canton, OH (US); Michael Paul Mallamaci, Canton, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 38 days.

(21) Appl. No.: 10/172,936

(22) Filed: Jun. 17, 2002

(65) Prior Publication Data

US 2003/0013556 A1 Jan. 16, 2003

Related U.S. Application Data

(60) Provisional application No. 60/298,697, filed on Jun. 15, 2001.

(51) Int. Cl.[7] ..... A63B 37/06; C08F 2/42

(52) U.S. Cl. ..... 525/333.2; 525/268; 525/269; 525/274; 473/371; 473/372; 473/377

(58) Field of Search ..... 525/268, 269, 525/274, 333.2; 471/371, 372, 377

(56) References Cited

U.S. PATENT DOCUMENTS

| | | | | | |
|---|---|---|---|---|---|
| 3,374,191 | A | * | 3/1968 | Nutzel | 524/526 |
| 5,858,903 | A | * | 1/1999 | Sylvester et al. | 502/118 |
| 6,194,505 | B1 | * | 2/2001 | Sone et al. | 524/432 |

* cited by examiner

*Primary Examiner*—David J. Buttner
(74) *Attorney, Agent, or Firm*—Alvin T. Rockhill

(57) ABSTRACT

It has been unexpectedly discovered that cis-1,4-polybutadiene that is synthesized utilizing Zeigler-Natta catalyst systems has superior characteristics for utilization in solid golf ball cores if the polymerization is terminated utilizing a carboxylic acid of the structural formula RCOOH, wherein R represents an alkyl group containing from 1 to about 30 carbon atoms.

22 Claims, No Drawings

GOLF BALL

The subject patent application claims the benefit of U.S. Provisional Application Ser. No. 60/298,697, filed on Jun. 15, 2001.

BACKGROUND OF THE INVENTION

U.S. Pat. No. 4,929,678 discloses a rubber composition for a solid golf ball having excellent durability and rebound properties comprising: (a) a rubber component comprising at least 40 percent by weight of a polybutadiene rubber which has a Mooney ML 1+4 viscosity of 50 to 70 and a cis-1,4 bond content of at least 80 percent, (b) a co-crosslinking agent and (c) a peroxide. The polybutadiene rubber that is utilized in manufacturing golf balls can be synthesized utilizing a wide variety of organometallic catalyst systems. For instance, some representative examples of organometallic catalyst systems that can be used include trialkyl aluminum-nickel carboxylate-boron trifuoride etherate systems, trialkyl aluminum-organonickel compound-hydrogen fluoride systems, alkyl aluminum halide-cobalt carboxylate systems, alkyl aluminum-titanium salt systems, alkyl aluminum-titanium salt-iodine complexes, alkyl lithium compounds, alkyl lithium-amine complexes, neodymium halide-alkyl aluminum systems, neodymium carboxylate-alkyl aluminum-alkyl aluminum halide systems, and organoneodymium compound-alkyl aluminum halide systems.

Rare earth catalyst systems can be employed in synthesizing the cis-1,4-polybutadiene. For example, 1,3-butadiene monomer can be polymerized with a catalyst system which is comprised of (1) an organoaluminum compound, (2) an organometallic compound which contains a metal from Group III-B of the Periodic System, such as a lanthanide selected from the group consisting of neodymium, praseodymium, cerium, and gadolinium, and (3) at least one compound which contains at least one labile halide ion.

U.S. Pat. No. 4,663,405 is based upon the use of vinyl halides as molecular weight regulators in polymerizations which are catalyzed with rare earth metal catalyst systems. U.S. Pat. No. 4,663,405 more specifically discloses a process for polymerizing conjugated diolefin monomers into polymers which utilizes a catalyst system which is comprised of (1) an organoaluminum compound, (2) an organometallic compound which contains a metal from Group III-B of the Periodic System, such as a lanthanide selected from the group consisting of neodymium, praseodymium, cerium, and gadolinium, and (3) at least one compound which contains at least one labile halide ion; wherein the molecular weight of the polymer produced in reduced by conducting the polymerization in the presence of a vinyl halide, such as vinyl bromide, vinyl chloride, and vinyl iodide.

Ziegler-Natta catalyst systems are commonly used in the polymerization of conjugated diolefin monomers, such as 1,3-butadiene, into rubbery polymers. Nickel-based catalyst systems are commonly used in the polymerization of 1,3-butadiene monomer into cis-1,4-polybutadiene rubber. Such nickel-based catalyst systems contain (a) an organonickel compound, (b) an organoaluminum compound and (c) a fluorine containing compound. Such nickel-based catalyst systems and their use in the synthesis of cis-1,4-polybutadiene is described in detail in U.S. Pat. Nos. 3,856,764, 3,910,869 and 3,962,375.

Various compounds have been found to act as molecular weight-reducing agents when used in conjunction with the nickel-based catalyst system. For instance, U.S. Pat. No. 4,383,097 discloses that alpha-olefins, such as ethylene and propylene, act as molecular weight-reducing agents when utilized in conjunction with such three-component nickel catalyst systems. U.S. Pat. No. 5,698,643 indicates that 1-butene, isobutylene, cis-2-butene, trans-2-butene and allene act as molecular weight regulators when used in conjunction with such nickel-based catalyst systems. U.S. Pat. No. 4,383,097 reveals that certain nonconjugated diolefins, such as 1,4-pentadiene, 1,6-heptadiene and 1,5-hexadiene, act as molecular weight-reducing agents when utilized in conjunction with such catalyst systems. U.S. Pat. No. 5,100,982 indicates that cis-1,4-polybutadiene having reduced molecular weight and a broad molecular weight distribution can be synthesized with certain nickel-based catalyst systems in the presence of halogenated phenols, such as para-chlorophenol.

U.S. Pat. No. 5,451,646 discloses that para-styrenated diphenylamine acts as a molecular weight-reducing agent when employed in conjunction with nickel-based catalyst systems which contain (a) an organonickel compound, (b) an organoaluminum compound and (c) a fluorine containing compound. The teachings of U.S. Pat. No. 5,451,646 also indicate that para-styrenated diphenylamine acts to improve the processability of cis-1,4-polybutadiene rubbers prepared in their presence utilizing such nickel-based catalyst systems. Para-styrenated diphenylamine can be employed in conjunction with such nickel-based catalyst systems to reduce the molecular weight of the rubber without sacrificing cold flow characteristics. The para-styrenated diphenylamine that remains in the rubber produced also acts in a manner that provides it with antioxidant protection. In other words, the para-styrenated diphenylamine accomplishes two major objectives. It acts as a molecular weight regulator and acts as an antidegradant.

U.S. Pat. No. 5,451,646 specifically discloses a process for producing cis-1,4-polybutadiene having a reduced molecular weight and improved processability which comprises polymerizing 1,3-butadiene in the presence of (a) an organonickel compound, (b) an organoaluminum compound, (c) a fluorine containing compound and (d) para-styrenated diphenylamine; wherein the organoaluminum compound and the fluorine containing compound are brought together in the presence of the para-styrenated diphenylamine.

After the desired degree of monomer conversion has been attained in polymerizations that are conducted with organometallic catalyst systems a terminator (short-stop) is added to terminate the polymerization. Rosin acids are commonly used as terminators for such polymerizations. The rosin acids that are used on a commercial basis are comprised predominately of abietic acid that contains about 10 percent of a mixture dihydroabietic acid and dehydroabietic acid. Abietic acid is of the structural formula:

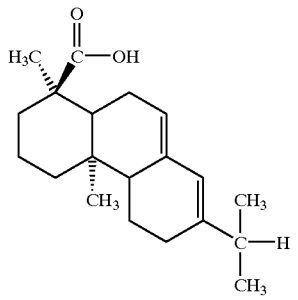

SUMMARY OF THE INVENTION

This invention is based upon the unexpected discovery that cis-1,4-polybutadiene that is synthesized utilizing organometallic catalyst systems has superior characteristics for utilization in solid golf ball cores if the polymerization is short-stopped utilizing a carboxylic acid of the structural formula RCOOH, wherein R represents an alkyl group containing from 1 to about 30 carbon atoms.

The present invention more specifically discloses a golf ball which is comprised of a solid core and a resin cover, wherein the solid core is comprised of cis-1,4-polybutadiene rubber which is made by polymerizing 1,3-butadiene in the presence of an organometallic catalyst system wherein the polymerization is short-stopped with a carboxylic acid of the structural formula RCOOH, wherein R represents an alkyl group containing from 1 to about 30 carbon atoms.

The present invention further reveals a rubber composition for a solid golf ball having excellent durability and rebound properties comprising: (a) cis-1,4-polybutadiene rubber, wherein said cis-1,4-polybutadiene rubber has a Mooney ML 1+4 viscosity of 30 to 90, wherein said cis-1,4-polybutadiene rubber has a cis-1,4 bond content of at least 95 percent, wherein cis-1,4-polybutadiene rubber is made by polymerizing 1,3-butadiene in the presence of organometallic catalyst system, wherein the polymerization is short-stopped by the addition of a carboxylic acid of the structural formula RCOOH, wherein R represents an alkyl group containing from 1 to about 30 carbon atoms.

DETAILED DESCRIPTION OF THE INVENTION

The cis-1,4-polybutadiene rubber used in the golf balls of this invention is synthesized by polymerizing 1,3-butadiene monomer utilizing a standard organometallic catalyst system. However, after the desired level of monomer conversion is attained the polymerization is terminated (short-stopped) by the addition of a carboxylic acid of the structural formula RCOOH, wherein R represents an alkyl group containing from 1 to about 30 carbon atoms.

The cis-1,4-polybutadiene rubber can be synthesized utilizing a solution polymerization, bulk polymerization, or a vapor phase polymerization technique. Such polymerizations can be carried out as on a continuous basis or as a batch process. However, the cis-1,4-polybutadiene will typically be synthesized by solution polymerization in a hydrocarbon solvent which can be one or more aromatic, paraffinic or cycloparaffinic compounds. These solvents will normally contain from 4 to about 10 carbon atoms per molecule and will be liquids under the conditions of the polymerization. Some representative examples of suitable organic solvents include isooctane, cyclohexane, normal hexane, benzene, toluene, xylene, ethylbenzene, and the like, alone or in admixture.

In the solution polymerizations employed in the synthesis of the cis-1,4-polybutadiene, there will normally be from about 5 to about 35 weight percent monomers in the polymerization medium. Such polymerization media are, of course, comprised of the organic solvent and the 1,3-butadiene monomer. As the polymerization proceeds, monomer is converted to polymer and accordingly the polymerization medium will contain from about 5 to about 35 weight percent unreacted monomers and polymer. In most cases, it will be preferred for the polymerization medium to contain from about 10 to about 30 weight percent monomers and polymers. It is generally more preferred for the polymerization medium to contain from 20 to 25 weight percent monomers and polymers.

The catalyst systems that can be used include Ziegler-Natta systems, rare earth systems, and anionic initiators that are based upon a Group Ia metal, such as lithium, potassium, rubidium, or cesium. Some representative examples of some specific organometallic catalyst systems that can be used include trialkyl aluminum-nickel carboxylate-boron trifuoride etherate systems, trialkyl aluminum-organonickel compound-hydrogen fluoride systems, alkyl aluminum halide-cobalt carboxylate systems, alkyl aluminum-titanium salt systems, alkyl aluminum-titanium salt-iodine complexes, alkyl lithium compounds, alkyl lithium-amine complexes, neodymium halide-alkyl aluminum systems, neodymium carboxylate-alkyl aluminum-alkyl aluminum halide systems, and organoneodymium compound-alkyl aluminum halide systems.

Nickel catalyst systems and rare earth catalyst systems are highly useful in the practice of this invention. The rare earth catalyst systems that can be employed in synthesizing the cis-1,4-polybutadiene utilize a metal from Group III-B of the Periodic System. For example, 1,3-butadiene monomer can be polymerized with a catalyst system which is comprised of (1) an organoaluminum compound, (2) an organometallic compound which contains a metal from Group III-B of the Periodic System, such as a lanthanide selected from the group consisting of neodymium, praseodymium, cerium, and gadolinium, and (3) at least one compound which contains at least one labile halide ion. U.S. Pat. No. 4,663,405 described such a rare earth catalyst system and the teachings of U.S. Pat. No. 4,663,405 are incorporated herein by reference in their entirety.

The nickel catalyst systems that are useful in the practice of this invention are comprised of (a) an organonickel compound, (b) an organoaluminum compound, (c) a fluorine containing compound. Such nickel based catalyst systems are described in U.S. Pat. No. 5,451,646 and the teachings of U.S. Pat. No. 5,451,646 are incorporated herein by reference in their entirety The organoaluminum compounds that can be utilized in the rare earth and nickel catalyst systems are of the structural formula:

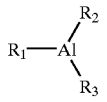

in which $R_1$ is selected from the group consisting of alkyl groups (including cycloalkyl), aryl groups, alkaryl groups, arylalkyl groups, alkoxy groups, hydrogen and fluorine; $R_2$ and $R_3$ being selected from the group consisting of alkyl groups (including cycloalkyl), aryl groups, alkaryl groups and arylalkyl groups. It is preferred for $R_1$, $R_2$ and $R_3$ to represent alkyl groups which contain from 1 to about 10 carbon atoms. It is more preferred for $R_1$, $R_2$ and $R_3$ to represent alkyl groups which contain from two to five carbon atoms.

Some representative examples of organoaluminum compounds that can be utilized are diethyl aluminum hydride, di-n-propyl aluminum hydride, di-n-butyl aluminum hydride, diisobutyl aluminum hydride, diphenyl aluminum hydride, di-p-tolyl aluminum hydride, dibenzyl aluminum hydride, phenyl ethyl aluminum hydride, phenyl-n-propyl aluminum hydride, p-tolyl ethyl aluminum hydride, p-tolyl n-propyl aluminum hydride, p-tolyl isopropyl aluminum hydride, benzyl ethyl aluminum hydride, benzyl n-propyl aluminum hydride, and benzyl isopropyl aluminum hydride, diethylaluminum ethoxide, diisobutylaluminum ethoxide, dipropylaluminum methoxide, trimethyl aluminum, triethyl aluminum, tri-n-propyl aluminum, triisopropyl aluminum, tri-n-butyl aluminum, triisobutyl aluminum, tripentyl aluminum, trihexyl aluminum, tricyclohexyl aluminum, trioctyl aluminum, triphenyl aluminum, tri-p-tolyl aluminum, tribenzyl aluminum, ethyl diphenyl aluminum, ethyl di-p-tolyl aluminum, ethyl dibenzyl aluminum, diethyl phenyl aluminum, diethyl p-tolyl aluminum, diethyl benzyl aluminum and other triorganoaluminum compounds. The preferred organoaluminum compounds include triethyl aluminum (TEAL), tri-n-propyl aluminum, triisobutyl aluminum (TIBAL), trihexyl aluminum, diisobutyl aluminum hydride (DIBA-H) and diethyl aluminum fluoride.

The Group III-B metals that are useful as the organometallic compound of the rare earth catalyst systems include scandium, yttrium, the lanthanides, and the actinides. The lanthanides include lanthanum, cerium, praseodymium, neodymium, promethium, samarium, europium, gadolinium, terbium, dysprosium, holmium, erbium, thulium, ytterbium and lutetium. The actinides include actinium, thorium, protactinium, uranium, neptunium, plutonium, americium, curium, berkelium, californium, einsteinium, fermium, mendelerium, and lawrencium. The preferred actinides are thorium and uranium. The preferred Group III-B metals are cerium, praseodymium, neodymium and gadolinium. The most preferred lanthanide metal is neodymium.

In the organometallic compound utilized the organic portion includes organic type ligands or groups which contain from 1 to 20 carbon atoms. These ligands can be of the monovalent and bidentate or divalent and bidentate form. Representative of such organic ligands or groups are (1) o-hydroxyaldehydes such as salicylaldehyde, 2-hydroxyl-1-naphthaldehyde, 2-hydroxy-3-naphthaldehyde and the like; (2) o-hydroxyphenones such as 2'-hydroxyacetophenone, 2'-o-hydroxybutyrophenone, 2'-hydroxypropiophenone and the like: (3) aminophenols such as o-aminophenol, N-methyl o-aminophenol, N-ethyl o-aminophenol and the like: (4) hydroxy esters such as ethyl salicylate, propyl salicylate, butyl salicylate and the like: (5) phenolic compounds such as 2-hydroxyquinoline, 8-hydroxyquinoline and the like: (6) .beta.-diketones such as acetylacetone, benzoylacetone, propionylacetone, isobutyrylacetone, valerylacetone, ethylacetylacetone and the like; (7) monocarboxylic acids such as acetic acid, propionic acid, valeric acid, hexanoic acid, 2-ethylhexanoic acid, neodecanoic acid, lauric acid, stearic acid and the like: (8) ortho dihydric phenols such as pyrocatechol; (9) alkylene glycols such as ethylene glycol, propylene glycol, trimethylene glycol, tetramethylene glycol and the like: (10) dicarboxylic acids such as oxalic acid, malonic acid, maleic acid, succinic acid, o-phthalic acid and the like: (11) alkylated derivatives of the above-described dicarboxylic acids; (12) phenolic ethers such as o-hydroxyanisole, o-hydroxyethyl phenol ether and the like.

Representative organometallic compounds of the Group III-B metals, corresponding to the formula $ML_3$, which may be useful include cerium acetylacetonate, cerium naphthenate, cerium neodecanoate, cerium octanoate, tris-salicylaldehyde cerium, cerium tris-(8-hydroxyquinolate), gadolinium naphthenate, gadolinium neodecanoate, gadolinium octanoate, lanthanum naphthenate, lanthanum octanoate, neodymium naphthenate, neodymium neodecanoate, neodymium octanoate, praseodymium naphthenate, prasodymium octanoate, yttrium acetylacetonate, yttrium octanoate, dysprosium octanoate, tris(π-allyl) uranium chloride, tris(π-allyl) uranium bromide, tris(π-allyl) uranium iodide, uranium tetramethoxide, uranium tetraethoxide, uranium tetrabutoxide, uranium octanoate, thorium ethoxide, tris(π-allyl) thorium chloride, thorium naphthenate, uranium isovalerate, and other Group III-B metals complexed with ligands containing form 1 to 20 carbon atoms.

Some representative examples of halide ions that can be utilized include bromide ions, chloride ions, fluoride ions, and iodide ions. A combination of two or more of these ions can also be utilized. These halide ions can be introduced as (1) hydrogen halides: (2) alkyl, aryl, alkaryl, aralkyl and cycloalkyl metal halides wherein the metal is selected from the Groups II, III-A and IV-A of the Periodic Table; (3) halides of metals of Groups III, IV, V, VI-B and VIII of the Periodic Table and (4) organometallic halides corresponding to the general formula $ML_{(3-y)}X_y$ wherein M is a metal selected from the group consisting of metals of Group III-B of the Periodic Table having atomic numbers of 21, 39 and 57 through 71 inclusive: L is an organic ligand containing from 1 to 20 carbon atoms and selected from the group consisting of (a) o-hydroxyaldehydes, (b) o-hydroxyphenones, (c) hydroxyquinolines, (f) β-diketones, (g) monocarboxylic acids, (h) ortho dihydric phenols, (i) alkylene glycols, (j) dicarboxylic acids, (k) alkylated derivatives of dicarboxylic acids and (1) phenolic ethers; X is a halide ion and y is an integer ranging from 1 to 2 and representing the number of halide ions attached to the metal M. The organic ligand L may be of the monovalent and bidentate or divalent and bidentate form.

Representative examples of such compounds containing a labile halide ion include (1) inorganic halide acids, such as hydrogen bromide, hydrogen chloride and hydrogen iodide: (2) organometallic halides, such as ethylmagnesium bromide, butylmagnesium bromide, phenylmagnesium bromide, methylmagnesium chloride, butylmagnesium chloride, ethylmagnesium iodide, phenylmagnesium iodide, diethylaluminum bromide, diisobutylaluminum bromide, methylaluminum sesquibromide, diethylaluminum chloride, ethylaluminum dichloride, ethylaluminum sesquichloride, diisobutylaluminum chloride, isobutylaluminum dichloride, dihexylaluminum chloride, cyclohexylaluminum dichloride, phenylaluminum dichloride, didodecylaluminum chloride, diethylaluminum fluoride, dibutylaluminum fluoride, diethylaluminum iodide, dibutylaluminum iodide, phenylaluminum diiodide, trimethyltin bromide, triethyltin chloride, dibutyltin dichloride, butyltin trichloride, diphenyltin dichloride, tributyltin iodide and the like; (3) inorganic halides, such as aluminum bromide, aluminum chloride, aluminum iodide, antimony pentachloride, antimony trichloride, boron tribromide, boron trichloride, ferric chloride, gallium trichloride, molybdenum pentachloride, phosphorus tribromide, phosphorus pentachloride, stannic chloride, titanium tetrachloride, titanium tetraiodide, tungsten hexachloride and the like: and (4) organometallic (Group III-B) halides, such as t-butylsalicylaldehydrocerium (III) chloride, salicylaldehydrocerium (III) chloride, 5-cyclohexylsalicylaldehydrocerium (III) chloride, 2-acetylphenolatocerium (III) chloride, oxalatocerium (III) chloride, oxalatocerium (III) bromide and the like. The preferred compounds which contain a labile halide ion are inorganic halide acids and organometallic halides.

The rare earth metal catalyst system can be prepared using an "in situ" technique or it can be "preformed." By "in situ" is meant that the catalyst components are added separately to the monomer to be polymerized. By "preformed" is meant the manner in which the catalyst components are mixed together prior to exposure of any of the components to the monomer to be polymerized. It is also known that when employing the type of catalyst system described in this invention, the presence of monomer is not essential to the formation of an active catalyst species, thus, facilitating the use of "preformed" catalysts. Also, it is known that freshly "preformed" catalysts are frequently less active than catalysts which have been allowed to age before use. Greatly improved "preformed" catalysts can be prepared by carrying out the "preforming" in the presence of small amounts of conjugated diolefins. Preforming in the presence of monomers results in homogeneous (soluble) catalyst systems, whereas those prepared by mixing in the absence of monomers are frequently heterogeneous (insoluble). Such a "preforming" technique is described in detail in U.S. Pat. No. 3,794,604 which is incorporated herein by reference.

The proportions of the components of the rare earth catalyst composition can be varied widely. When the halide ion of the halogen containing compound is bromide, chloride or iodide ion, the atomic ratio of the halide ion to the Group III-B metal can vary from about 0.1/1 to about 6/1. A more preferred ratio is from about 0.5/1 to about 3.5/1 and the most preferred ratio is about 2/1. However, when the halide ion of the halogen-containing compound is fluoride ion, the ratio of the fluoride ion to the Group III-B metal ion ranges from about 20/1 to about 80/1 with the most preferred ratio being about 30/1 to about 60/1. The molar ratio of the trialkylaluminum or alkylaluminum hydride to Group III-B metal can range from about 4/1 to about 200/1 with the most preferred range being from about 8/1 to about 100/1. The molar ratio of 1,3-butadiene monomer to Group III-B metal can range from about 0.2/1 to 3000/1 with the most preferred range being from about 5/1 to about 500/1.

The amount of catalyst charged to the reduction system can be varied over a wide range: the sole requirement being that a catalytic amount of the catalyst composition, sufficient to cause polymerization of the 1,3-butadiene monomer, be present in the reaction system. Low concentrations of catalyst are desirable in order to minimize ash problems. It has been found that polymerizations will occur when the catalyst level of the Group III-B metal varies between 0.05 and 1.0 millimole of Group III-B metal per 100 grams of monomer. A preferred ratio is between 0.1 and 0.3 millimole of Group III-B metal per 100 grams of monomer.

Any soluble organonickel compound can be employed in the nickel catalyst systems that can be used to polymerize 1,3-butadiene monomer into cis-1,4-polybutadiene. These soluble nickel compounds are normally compounds of nickel with a mono-dentate or bi-dentate organic ligands containing up to 20 carbon atoms. A ligand is an ion or molecule bound to and considered bonded to a metal atom or ion. Mono-dentate means having one position through which covalent or coordinate bonds with the metal may be formed. Bi-dentate means having two positions through which covalent or coordinate bonds with the metal may be formed. The term "soluble" refers to solubility in butadiene monomer and inert solvents.

Generally, any nickel salt or nickel containing organic acid containing from about 1 to 20 carbon atoms may be employed as the soluble nickel containing compound. Some representative examples of soluble nickel containing compounds include nickel benzoate, nickel acetate, nickel naphthenate, nickel octanoate, nickel neodecanoate, bis(α-furyl dioxime) nickel, nickel palmitate, nickel stearate, nickel acetylacetonate, nickel salicaldehyde, bis (cyclopentadiene) nickel, bis(salicylaldehyde) ethylene diimine nickel, cyclopentadienyl-nickel nitrosyl, bis(π-allyl nickel), bis(π cycloocta-1,5-diene), bis(π-allyl nickel trifluoroacetate) and nickel tetracarbonyl. The preferred component containing nickel is a nickel salt of a carboxylic acid or an organic complex compound of nickel. Nickel naphthenate, nickel octanoate and nickel neodecanoate are highly preferred soluble nickel containing compounds. Nickel 2-ethylhexanoate, which is commonly referred to as nickel octanoate (NiOct), is the soluble nickel containing compound which is most commonly used due to economic factors.

The fluorine containing compound utilized in the nickel catalyst system is generally hydrogen fluoride or boron trifluoride. If hydrogen fluoride is utilized, it can be in the gaseous or liquid state. In cases where hydrogen fluoride is employed, it should, of course, be anhydrous and as pure as possible. The hydrogen fluoride can be dissolved in an inert solvent and, thus, can be handled and charged into the reaction zone as a liquid solution. Optionally, butadiene monomer can be utilized as the solvent. Inert solvents include alkyl-, alkaryl-, arylalkyl- and aryl-hydrocarbons. For example, benzene and toluene are convenient solvents.

In cases where boron trifluoride is used as a component of the nickel catalyst, it can be in the gaseous state. It should also be anhydrous and as pure as possible. The hydrogen fluoride complexes and/or boron trifluoride complexes can also be utilized in the catalyst system as the fluorine containing compound. Hydrogen fluoride complexes and boron trifluoride complexes can readily be made with compounds which contain an atom or radical which is capable of donating electrons to or sharing electrons with hydrogen fluoride or boron trifluoride. Compounds capable of such associating are ethers, alcohols, ketones, esters, nitrites, amines and water. The ketone subclass can be defined by the formula

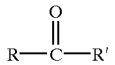

wherein R' and R are selected from the group consisting of alkyl radicals, cycloalkyl radicals, aryl radicals, alkaryl radicals and arylalkyl radicals containing from 1 to about 30 carbon atoms; and wherein R' and R can be the same or different. These ketones represent a class of compounds which have a carbon atom attached by a double bond to oxygen. Some representative examples of ketones that are useful in the preparation of the ketone-hydrogen fluoride complexes or boron trifluoride complexes of this invention include dimethyl ketone, methylethyl ketone, dibutyl ketone, methyl isobutyl ketone, ethyl octyl ketone, 2,4-pentanedione, butyl cycloheptanone, acetophenone, amylphenyl ketone, butylphenyl ketone, benzophenone, phenyltolyl ketone, quinone, and the like. The preferred ketones that can be used to form the ketone-hydrogen fluoride compounds and the ketone-boron trifluoride compounds of this invention are the dialkyl ketones of which acetone is most preferred.

The nitrile subclass can be represented by the formula RCN where R represents alkyl groups, cycloalkyl groups, aryl groups, alkaryl groups or arylalkyl groups that contain up to about 30 carbon atoms. The nitriles contain a carbon atom attached to a nitrogen atom by a triple bond. Representative but not exhaustive of the nitrile subclass are acetonitrile, butyronitrile, acrylonitrile, benzonitrile, tolunitrile, phenylacetonitrile, and the like. The preferred hydrogen fluoride-nitrile complex or boron trifluoride nitrile complex is the hydrogen fluoride benzonitrile complex or the boron trifluoride benzonitrile complex.

The alcohol subclass can be defined by the formula RCOOH where R represents alkyl radicals, cycloalkyl radicals, aryl radicals, alkaryl radicals or arylalkyl radicals containing from about 1 to about 30 carbon atoms. These alcohols represent a class of compounds which have a carbon atom attached by a single bond to oxygen which is in turn attached to a hydrogen by a single bond. Representative but not exhaustive of the alcohols useful in the preparation of hydrogen fluoride complexes and boron trifluoride complexes are methanol, ethanol, n-propanol, isopropanol, phenol, benzyl alcohol, cyclohexanol, butanol, hexanol and pentanol. The preferred hydrogen fluoride-alcohol complex or boron trifluoride alcohol complex is hydrogen fluoride phenolate complex or boron trifluoride phenolate complex.

The ether subclass can be defined by the formula R'OR where R and R' represent alkyl radicals, cycloalkyl radicals, aryl radicals, alkaryl radicals and arylalkyl radicals containing from about 1 to about 30 carbon atoms; wherein R and R' may be the same or dissimilar. The R may also be joined through a common carbon bond to form a cyclic ether with the ether oxygen being an integral part of the cyclic structure such as tetrahydrofuran, furan or dioxane. These ethers represent a class of compounds which have two carbon atoms attached by single bonds to an oxygen atom. Representative but not exhaustive of the ethers useful in the preparation of the hydrogen fluoride complexes or boron trifluoride complexes of this invention are dimethyl ether, diethyl ether, dibutyl ether, diamyl ether, diisopropyl ethers, tetrahydrofuran, anisole, diphenyl ether, ethyl methyl ether, dibenzyl ether, and the like. The preferred hydrogen fluoride-ether complexes or boron trifluoride-ether complexes are hydrogen fluoride diethyl etherate, hydrogen fluoride dibutyl etherate, boron trifluoride diethyl etherate and/or boron trifluoride dibutyl etherate complexes.

The ester subclass can be defined by the formula

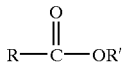

wherein R and R' are selected from the group consisting of alkyl radicals, cycloalkyl radicals, aryl radicals, alkaryl radicals and arylalkyl radicals containing from 1 to about 20 carbon atoms. The esters contain a carbon atom attached by a double bond to an oxygen atom as indicated. Representative but not exhaustive of such esters are ethyl benzoate, amyl benzoate, phenyl acetate, phenyl benzoate and other esters conforming to the formula above. The preferred hydrogen fluoride-ester complex is hydrogen fluoride ethyl benzoate complex. The preferred boron trifluoride-ester complex is boron trifluoride ethyl benzoate complex.

Such complexes are usually prepared by simply bubbling gaseous boron trifluoride or hydrogen fluoride into appropriate amounts of the complexing agent, for instance, a ketone, an ether, an ester, an alcohol or a nitrile. This should be done in the absence of moisture, and measures should be taken to keep the temperature from rising above about 100° F. (37.7° C.). In most cases, boron trifluoride and hydrogen fluoride complexes are prepared with the temperature being maintained at room temperature. Another possible method would be to dissolve the hydrogen fluoride or the complexing agent in a suitable solvent followed by adding the other component. Still another method of mixing would be to dissolve the complexing agent in a solvent and simply bubble gaseous hydrogen fluoride or boron trifluoride through the system until all of the complexing agent is reacted with the hydrogen fluoride or boron trifluoride. The concentrations can be determined by weight gain or chemical titration.

The three component nickel catalyst system utilized can be preformed. If the nickel catalyst system is preformed, it will maintain a high level of activity over a long period of time. The utilization of such a preformed nickel catalyst system also results in the formation of a uniform polymeric product. Such preformed nickel catalyst systems are prepared in the presence of one or more preforming agents selected from the group consisting of monoolefins, nonconjugated diolefins, conjugated diolefins, cyclic nonconjugated multiolefins, acetylenic hydrocarbons, triolefins, vinyl ethers and aromatic nitriles.

Some representative examples of olefins that can be used as the preforming agent in the preparation of stabilized catalysts are trans-2-butene, mixed cis and trans-2-pentene, and cis-2-pentene. Some nonconjugated diolefins that can be used as preforming agents are cis-1,4-hexadiene, 1,5-heptadiene, 1,7-octadiene, and the like. Representative examples of cyclic nonconjugated multiolefins that can be used include 1,5-cyclooctadiene, 1,5,9-cyclododecatriene and 4-vinyl cyclohexene-1. Some representative examples of acetylenic hydrocarbons which can be used as the preforming agent are methyl acetylene, ethyl acetylene, 2-butyne, 1-pentyne, 2-pentyne, 1-octyne and phenyl acetylene. Triolefins that can be used as the preforming agent include 1,3,5-hexatriene, 1,3,5-heptatriene, 1,3,6-octatriene, 5-methyl-1,3,6-heptatriene and the like. Some representative examples of substituted conjugated diolefins that can be used include 1,4-diphenyl butadiene, myrcene (7-methyl-3-methylene-1,6-octadiene), and the like. Ethyl vinyl ether and isobutyl vinyl ether are representative examples of alkyl vinyl ethers that can be used as the preforming agent. A representative example of an aromatic nitrile that can be used is benzonitrile. Some representative examples of conjugated diolefins that can be used include 1,3-butadiene, isoprene and 1,3-pentadiene. The preferred preforming agent is 1,3-butadiene.

A method of preparing the preformed catalyst so that it will be highly active and relatively chemically stable is to add the organoaluminum compound and the preforming agent to the solvent medium before they come into contact with the nickel compound and, optionally, para-styrenated diphenylamine. The nickel compound and the para-styrenated diphenylamine are then added to the solution with the fluoride compound being added to the solution subsequently. As an alternative, the preforming agent and the nickel compound may be mixed, followed by the addition of the organoaluminum compound, the para-styrenated diphenylamine and then the fluoride compound or the hydrogen fluoride/p-styrenated diphenylamine complex. Other orders of addition may be used but they generally produce less satisfactory results.

The amount of preforming agent used to preform the catalyst may be within the range of about 0.001 to 3 percent of the total amount of monomer to be polymerized. Expressed as a mole ratio of preforming agent to nickel compound, the amount of preforming agent present during the preforming step can be within the range of about 1 to 3000 times the concentration of nickel. The preferred mole ratio of preforming agent to nickel is about 3:1 to 500:1.

These preformed catalysts have catalytic activity immediately after being prepared. However, it has been observed that a short aging period, for example 15 to 30 minutes, at a moderate temperature, for example 50° C., increases the activity of the preformed catalyst greatly.

In order to properly stabilize the catalyst, the preforming agent must be present before the organoaluminum compound has an opportunity to react with either the nickel compound or the fluoride compound. If the catalyst system is preformed without the presence of at least a small amount of preforming agent, the chemical effect of the organoaluminum upon the nickel compound or the fluoride compound is such that the catalytic activity of the catalyst is greatly lessened and shortly thereafter rendered inactive. In the presence of at least a small amount of preforming agent, the catalytic or shelf life of the catalyst is greatly improved over the system without any preforming agent present.

The three component nickel catalyst system can also be premixed. Such premixed catalyst systems are prepared in the presence of one or more polymeric catalyst stabilizers. The polymeric catalyst stabilizer can be in the form of a liquid polymer, a polymer cement or a polymer solution. Polymeric catalyst stabilizers are generally homopolymers of conjugated dienes or copolymers of conjugated dienes with styrenes and methyl substituted styrenes. The diene monomers used in the preparation of polymeric catalyst stabilizers normally contain from 4 to about 12 carbon atoms. Some representative examples of conjugated diene monomers that can be utilized in making such polymeric catalyst stabilizers include isoprene, 1,3-butadiene, piperylene, 1,3-hexadiene, 1,3-heptadiene, 1,3-octadiene, 2,4-hexadiene, 2,4-heptadiene, 2,4-octadiene and 1,3-nonadiene. Also included are 2,3-dimethylbutadiene, 2,3-dimethyl-1,3-hexadiene, 2,3-dimethyl-1,3-heptadiene, 2,3-dimethyl-1,3-octadiene and 2,3-dimethyl-1,3-nonadiene and mixtures thereof.

Some representative examples of polymeric catalyst stabilizers include polyisoprene, polybutadiene, polypiperylene, copolymers of butadiene and styrene, copolymers of butadiene and α-methylstyrene, copolymers of isoprene and styrene, copolymers of isoprene and α-methylstyrene, copolymers of piperylene and styrene, copolymers of piperylene and α-methylstyrene, copolymers of 2,3-dimethyl-1,3-butadiene and styrene, copolymers of 2,3-dimethyl butadiene and α-methylstyrene, copolymers of butadiene and vinyltoluene, copolymers of 2,3-dimethyl-1,3-butadiene and vinyltoluene, copolymers of butadiene and α-methylstyrene, and copolymers of piperylene and α-methylstyrene.

In order to properly stabilize the catalyst system by this premixing technique, the polymeric catalyst stabilizer must be present before the organoaluminum compound has an opportunity to react with either the nickel compound or the fluorine containing compound. The para-styrenated diphenylamine will, of course, be present when the organoaluminum compound is brought into contact with the fluorine containing compound. If the catalyst system is premixed without the presence of at least a small amount of polymeric catalyst stabilizer, the chemical effect of the organoaluminum compound upon the nickel compound or the fluoride compound is such that the catalytic activity of the catalyst system is greatly lessened and shortly thereafter rendered inactive. In the presence of at least a small amount of polymeric catalyst stabilizer, the catalytic or shelf life of the catalyst system is greatly improved over the same system without any polymeric catalyst stabilizer present.

One method of preparing this premixed catalyst system so that it will be highly active and relatively chemically stable is to add the organoaluminum compound to the polymer cement solution and mix thoroughly before the organoaluminum compound comes into contact with the nickel containing compound. The nickel compound is then added to the polymer cement solution. Alternatively, the nickel compound can be mixed with the polymer cement first, followed by the addition of the organoaluminum compound and, optionally, the para-styrenated diphenylamine. Then, the fluorine containing compound is added to the polymer cement solution. This is not intended to preclude other orders or methods of catalyst addition, but it is emphasized that the polymer stabilizer must be present before the organoaluminum compound has a chance to react with either the nickel containing compound or the fluorine containing compound.

The amount of polymeric catalyst stabilizer used to premix the catalyst system can be within the range of about 0.01 to 3 weight percent of the total amount monomer to be polymerized. Expressed as a weight ratio of polymeric catalyst stabilizer to nickel, the amount of polymeric catalyst stabilizer present during the premixing step can be within the range of about 2 to 2000 times the concentration of nickel. The preferred weight ratio of polymeric catalyst stabilizer to nickel is from about 4:1 to about 300:1. Even though such premixed catalyst systems show catalytic activity immediately after being prepared, it has been observed that a short aging period, for example 15 to 30 minutes, at moderate temperatures, for example 50° C., increases the activity of the preformed catalyst system.

A "modified in situ" technique can also be used in making the three component nickel catalyst system. In fact, the utilization of catalysts made by such "modified in situ" techniques results in more uniform control of the polymerization and the polymeric product. In such a "modified in situ" technique, the organoaluminum compound is added to neat 1,3-butadiene monomer with the nickel containing compound and, optionally, the para-styrenated diphenylamine being added later. The butadiene monomer containing the organoaluminum compound, the para-styrenated diphenylamine and the nickel containing compound is then charged into the reaction zone being used for the polymerization with the fluorine containing compound being charged into the reaction zone separately. Normally, the organoaluminum compound, the para-styrenated diphenylamine and the nickel containing compound are charged into the reaction zone soon after being mixed into the butadiene monomer. In most cases, the organoaluminum compound, the para-styrenated diphenylamine and the nickel containing compound are charged into the reaction zone within 60 seconds after being mixed in the butadiene monomer. It will generally be desirable to utilize organoaluminum compounds and nickel containing compounds which have been dissolved in a suitable solvent.

Nickel catalyst systems have activity over a wide range of catalyst concentrations and catalyst component ratios. The three catalyst components interact to form the active catalyst system. As a result, the optimum concentration for any one component is very dependent upon the concentrations of each of the other two catalyst components. Furthermore, while polymerization will occur over a wide range of catalyst concentrations and ratios, the most desirable properties for the polymer being synthesized are obtained over a relatively narrow range. Polymerizations can be carried out utilizing a mole ratio of the organoaluminum compound to the nickel containing compound within the range of from about 0.3:1 to about 300:1; with the mole ratio of the fluorine containing compound to the organonickel containing compound ranging from about 0.5:1 to about 200:1 and with the mole ratio of the fluorine containing compound to the organoaluminum compound ranges from about 0.4:1 to about 10:1. The preferred mole ratios of the organoaluminum compound to the nickel containing compound ranges from about 3:1 to about 100:1, and the preferred mole ratio of the fluorine containing compound to the organoaluminum compound ranges from about 0.7:1 to about 7:1. The concentration of the catalyst system utilized in the reaction zone depends upon factors such as purity, the reaction rate desired, the polymerization temperature utilized, the reactor design and other factors.

In order to facilitate charging the catalyst components into the reaction zone "in situ," they can be dissolved in a small amount of an inert organic solvent or butadiene monomer. Preformed and premixed catalyst systems will, of course, already be dissolved in a solvent.

The amount of molecular weight regulator that needs to be employed varies with the catalyst system, with the polymerization temperature and with the desired molecular weight of the high cis-1,4-polybutadiene rubber being synthesized. For instance, if a high molecular weight rubber is desired, then a relatively small amount of molecular weight regulator is required. On the other hand, in order to reduce molecular weights substantially, a relatively large amount of the molecular weight regulator will need to be employed. Generally, greater amounts of the molecular weight regulator are required when the catalyst system being utilized contains hydrogen fluoride or is an aged catalyst which contains boron trifluoride. However, as a general rule, from about 0.25 phm (parts by weight per hundred parts of monomer) to about 1.5 phm of the molecular weight regulator will be employed. The molecular weight regulators that can be used include α-olefins, such as ethylene, propylene, and 1-butene, cis-2-butene, trans-2-butene, isobutene, and para-styrenated diphenylamine.

It is normally preferred to utilize 0.5 phm to 0.75 phm of para-styrenated diphenylamine as the molecular weight ragulator because, at such concentrations, good reductions in molecular weight can be realized and the high cis-1,4-polybutadiene rubber produced is provided with a good level of stabilization. In such cases, the molecular weight of the rubber being synthesized can be controlled by adjusting the ratio of the fluorine containing compound to the organoaluminum compound. In other words, at constant levels of the para-styrenated diphenylamine within the range of 0.25 phm to 1.5 phm, the molecular weight of the polymer being synthesized can be controlled by varying the ratio of the fluorine containing compound to the organoaluminum compound. Maximum reductions in molecular weight and maximum conversions normally occur at molar ratios of the fluorine containing compound to the organoaluminum compound which are within the range of 1.5:1 to 2:1. At molar ratios of less than 1.5:1 and at molar ratios within the range of 2:1 to 2.75:1, lesser reductions in molecular weight occur.

The temperatures utilized in the polymerizations of this invention are not critical and may vary from extremely low temperatures to very high temperatures. For instance, such polymerizations can be conducted at any temperature within the range of about −10° C. to about 120° C. The polymerization will preferably be conducted at a temperature within the range of about 30° C. to about 110° C. It is normally preferred for the polymerization to be carried out at a temperature that is within the range of about 70° C. to about 95° C. Such polymerizations will normally be conducted for a period of time that is sufficient to attain a high yield that is normally in excess of about 80 percent and preferably in excess of about 90 percent.

After the desired conversion has been achieved a carboxylic acid of the structural formula RCOOH, wherein R represents an alkyl group containing from 1 to about 30 carbon atoms will be added to terminate the polymerization. The carboxylic acid will typically contain from 2 to 11 carbon atoms and preferably contain from 5 to 10 carbon atoms. It is most preferred for the carboxylic acid to contain from 8 to 10 carbon atoms. Typically a stoichiometric excess of the alcohol to nickel about 5 to about 500 mole percent will be added to terminate the polymerization. More typically a stoichiometric excess of alcohol to nickel about 5 to about 10 mole percent will be added to terminate the polymerization. It has been found that the use of a stoichiometric amount or an excess of the alcohol acts to improve the performance of curing agents, both sulfur-based and peroxide based.

Low molecular weight alcohols that contain from about 2 to about 10 carbon atoms, typically, from about 2 to about 4 carbon atoms, can be used. Alcohols having higher molecular weights that contain from about 12 to about 30 carbon atom, typically from about 14 to about 22 carbon atoms, can also be used.

After the polymerization is completed, the cis-1,4-polybutadiene rubber may be recovered from the resulting polymer solution (rubber cement) by any of several procedures, such as coagulation, steam stripping, or direct desolventization methods, including flash evaporation, vacuum drying, extruder drying, and the like. One such procedure comprises mixing the rubber cement with a polar coagulating agent, such as methanol, ethanol, isopropylalcohol, acetone, or the like. The coagulating agent can be added at room temperature or below whereupon the liquified low molecular weight hydrocarbons will vaporize. If desired, gentle heat may be applied to hasten the removal of low molecular weight hydrocarbons, but not sufficient heat to vaporize the polar coagulating agent. The vaporized low molecular weight hydrocarbon solvents can then be recovered and recycled. The coagulated rubber is recovered from the slurry of the polar coagulating agent by centrifugation, decantation or filtration.

Another procedure for recovering the cis-1,4-polybutadiene rubber is by subjecting the rubber solution to spray drying. Such a procedure is particularly suitable for continuous operations and has the advantage that heat requirements are at a minimum. When such a procedure is used, the recovered polymer should be washed soon after recovery with a polar solvent in order to destroy the remaining active catalyst contained in the polymer. In such procedures, the vaporized organic solvents are also easily recovered but will normally require purification before being recycled.

Cis-1,4-polybutadiene rubber synthesized with nickel catalyst systems typically has a cis content in excess of about 95 percent. For example, the cis-1,4-polybutadiene rubber will typically have a cis content of about 97 percent, a trans content of about 2 percent and a vinyl content of about 1 percent.

The cis-1,4-polybutadiene rubber made by the process of this invention has exceptional characteristics for utilization in manufacturing solid golf balls. For instance, golf balls manufactured with such cis-1,4-polybutadiene rubber have superior rebound properties and fatigue resistance. The cis-1,4-polybutadiene will typically have a Mooney ML 1+4 viscosity at 100° C. which is within the range of about 30 to about 90. The cis-1,4-polybutadiene will preferably have a Mooney ML 1+4 viscosity at 100° C. which is within the range of 40 to 80 and will most preferably have a Mooney ML 1+4 viscosity at 100° C. which is within the range of 50 to 75.

Solid golf balls generally include a core and a resin cover. The solid golf ball design may include a core obtained by one piece molding or be of a multi-piece design where one or more layers are coated onto the core. In any case, such solid golf balls of this invention include a resilient portion obtained by vulcanizing the cis-1,4-polybutadiene rubber containing composition which also includes a co-crosslinking agent, and a peroxide.

In addition to the cis-1,4-polybutadiene rubber, the resilient portion of the golf ball may also contain additional rubbers, such as styrene-butadiene rubber, natural rubber, synthetic polyisoprene rubber, styrene-isoprene rubber, and the like. The amount of such additional rubbers that can be included in the resilient portion of the golf ball will normally be no more than about 60 phr (parts per 100 parts by weight of rubber), based upon the total amount of rubber included in the resilient portion of the golf ball. Thus, the resilient portion of the golf ball will normally contain from about 40 phr to 100 phr of the cis-1,4-polybutadiene and from 0 phr to about 60 phr of such additional rubbers. It is normally preferred for such additional rubbers to be present in the resilient portion of the golf ball at a level of no more than about 30 phr. It is normally more preferred for such additional rubbers to be present in the resilient portion of the golf ball at a level of no more than about 15 phr.

The co-crosslinking agent used in the resilient portion of the golf ball will typically be an unsaturated carboxylic acid or a metal salt thereof. For example, the co-crosslinking agent can be acrylic acid, methacrylic acid, zinc acrylate, zinc methacrylate or a mixture thereof. The co-crosslinking agent will typically be present in the rubbery component of the golf ball at a level which is within the range of about 15 phr to about 60 phr. The co-crosslinking agent will typically be present in the resilient portion of the golf ball at a level which is within the range of about 25 phr to about 40 phr.

The peroxide used in the resilient portion of the golf ball will typically be an organic peroxide, such as dicumyl peroxide, t-butylperoxybenzoate or di-t-butylperoxide. It is normally preferred to use dicumyl peroxide in such golf ball compounds. The peroxide will typically be present in the rubbery component of the golf ball at a level which is within the range of about 0.5 phr to about 3 phr. The peroxide will preferably be present in the rubbery component of the golf ball at a level that is within the range of about 1 phr to about 2.5 phr.

Golf balls normally have a diameter that is within the range of about 41.15 mm to about 42.67 mm. To meet standardized weight requirements, the resilient portion of the golf ball will also typically contain a filler. Some representative examples of fillers that can be used include barium sulfate, zinc oxide, calcium carbonate, silica, and the like. Antidegradants can also be included in the rubbery component of the golf ball to protect it from degradation.

The rubber compound for the resilient portion of the golf ball can be prepared by mixing the cis-1,4-polybutadiene, the co-crosslinking agent, the peroxide, the optional filler and any other optional materials by conventional mixing techniques, such as by means of a roller or a kneader. The mixing will normally be carried out for about 10 to about 30 minutes, preferably about 15 to about 25 minutes, at a temperature of 50° C. to 140° C., preferably 70° C. to 120° C.

The solid golf ball can be a one-piece solid golf ball, a two-piece solid golf ball or a multi-piece solid golf ball. The one-piece solid golf ball can be prepared by vulcanizing the rubber compound through one piece molding. The two-piece and multi-piece solid golf balls normally include a solid core which is comprised of the resilient rubbery compound and a resin cover. In the case of multi-piece solid golf balls, the solid core is composed of a center core which is comprised of the resilient rubbery compound and one or more outer layers coated thereon. At least a portion of the solid core is prepared by vulcanizing the rubber composition of the present invention. The vulcanization will be conducted at a temperature which is within the range of about 140° C. to 170° C. for about 20 to 40 minutes. The resin cover is one typically comprised of an ionomer resin or a mixture of ionomer resins. Suitable ionomer resins are commercially available from the Mitsui Polychemical Company under the trade names Himilan® 1707, Himilan® 1706 and Himilan® 1605.

The practice of this invention is further illustrated by the following examples which are intended to be representative rather than restrictive of the scope of the subject invention. Unless indicated otherwise, all parts and percentages are given by weight.

EXAMPLE 1

Golf balls can be manufactured by first making a golf ball core compound by mixing 100 phr of cis-1,4-polybutadiene rubber with 30 phr of zinc acrylate, 22 phr of zinc oxide, 2 phr of dicumylperoxide and 0.5 phr of antioxidant. The golf ball core compound can then be molded and cured at a temperature of 145° C. for 40 minutes into solid cores having a diameter of 38.5 mm. The solid cores can then be covered with Himilan® 1707 ionomer that contains about 2 parts by weight of titanium dioxide to produce golf balls. Such golf balls exhibit improved compression, an improved coefficient of restitution and improved durability.

EXAMPLE 2

Golf balls can be manufactured by first making a golf ball core compound by mixing 100 phr of cis-1,4-polybutadiene with 25 phr of methacrylic acid, 25 phr of zinc oxide and 1 phr of dicumylperoxide. The golf ball core compound can then be molded and cured at a temperature of 170° C. for 25 minutes into solid cores having a diameter of 38.5 mm. The solid cores can then be covered with Himilan® 1707 ionomer that contains about 2 parts by weight of titanium dioxide to produce golf balls. Such golf balls exhibit improved compression, an improved coefficient of restitution and improved durability.

EXAMPLE 3

In this experiment a polybutadiene polymer was produced in accordance with the teachings of U.S. Pat. No. 5,698,643. In the procedure used, a 15% (w/w) 1,3-butadiene premix in hexane was column passed through dry silica under a blanket of dry nitrogen. For every 100 parts of butadiene premix, 3.3 phm of 1-butene is added as a chain transfer agent. In order, 0.322 phm triisobutylaluminum, 0.014 phm $Ni(oct)_2$, and 0.081 phm of anhydrous HF in butyl ether were charged to the reactor containing the butadiene premix. The polymerization is performed at 70° C. for 2 hours. The yield is 95% with respect to monomer.

A small sample was removed from the reactor, terminated with a slight excess of isopropanol, stabilized with 0.30 phr of Wingstay K antioxidant, and dried. After passing 10 times on a 100° F. mill, the ML1+4 was found to be 53.2. $C^{13}$ NMR revealed a microstructural content of 98.5% cis, 0.4% trans, and 1.1% 1,2-vinyl.

EXAMPLE 4

A set of seven terminators were chosen for demonstration, purchased from Sigma-Aldrich Chemical, and used without further purification. This set was divided into three classes:

aliphatic alcohols (ethanol, 2-ethylhexanol, 1-octadecanol), aliphatic acids (acetic acid, 2-ethylhexanoic acid, octadecanoic acid) and the rosin acid (abietic acid) control. Seven 5-gallon pails were dried at 50° C. and sparged with nitrogen. Two molar equivalents, with respect to Ni and Al content, of each of the seven terminators were added into each pail, and the pails were blanketed again with nitrogen before closing. Into each 5 gallon pail was piped 8200 gms of catalytically-active rubber cement under nitrogen pressure. The pails were then rolled on a drum roller for 12 hours.

At the end of 12 hours the pails were opened and 0.30 phr of Polygard HR (TNPP) was added as a stabilizer. The pails were then closed and allowed to roll for an additional 6 hours. The pails were opened and the contents were poured into large drying trays, placed into fume hoods, and allowed to dry for 7 days. The dried rubber mats were passed 10 times through a 100° F. mill to prepare the samples for compounding. Less than 0.1% total volatile compounds were found for all samples.

EXAMPLE 5

A screening formulation, shown in Table I, was used for all rubbers in the set. The method of dry compounding was as follows. To a Banbury™ mixer with an initial temperature of 75° F. was added half of the rubber, the zinc diacrylate and the zinc oxide at a ram pressure of 40 psi and a rotor speed of 25 rpm. As soon as the initial addition massed, the second half of the rubber was added. The internal temperature of the mix was monitored and the rpm varied to make sure the temperature did not exceed 180° F. At the each minute interval, the ram was opened and swept. At the end of 5 minutes, the compound was dumped, rolled on a 100° F. mill and allowed to cool to room temperature.

TABLE I

| Material | Loading (phr) |
|---|---|
| Cis-polybutadiene | 100.00 |
| Zinc diacrylate | 30.00 |
| Zinc oxide | 5.00 |
| Dicumyl peroxide | 0.40 |
| Total | 135.40 |

After the nonproductive cooled, it was placed back on a 100° F. mill. The compound was passed five times on the left, right and end and the peroxide added. The compound was then allowed to cool.

EXAMPLE 6

A few grams of each compounded material were collected. Cure rheology was performed on a rheoTECH MD+MDR at 335° F., with 0.5° arc and 20 inch lbs torque range. The results for each rubber/terminator pair are described in Table II.

TABLE II

| Catalyst Terminator | $Torque_{max}$ | $Torque_{min}$ | Delta Torque | $T_c90$ (minutes) |
|---|---|---|---|---|
| Ethanol | 89.28 | 1.26 | 88.02 | 5.51 |
| 2-ethylhexanol | 95.05 | 1.34 | 93.71 | 5.54 |
| 1-octadecanol | 87.61 | 1.40 | 86.21 | 5.05 |
| Acetic acid | 91.43 | 1.27 | 90.16 | 5.43 |
| 2-ethyl hexanoic acid | 92.86 | 1.38 | 91.48 | 5.56 |

TABLE II-continued

| Catalyst Terminator | $Torque_{max}$ | $Torque_{min}$ | Delta Torque | $T_c90$ (minutes) |
|---|---|---|---|---|
| Octadecanoic acid | 89.98 | 1.21 | 88.77 | 5.08 |
| Abietic acid (control) | 88.81 | 1.05 | 87.76 | 7.05 |

EXAMPLE 7

Each of the seven golf-ball compounds were analyzed for their high-speed resilience properties. This property, known as the coefficient of restitution (CoR), was analyzed at 125 ft/sec, as taught by Kennedy III, et al., in U.S. Pat. No. 6,290,614. In the course of this work, a pneumatically driven cannon was built, as taught as taught by Sullivan, et al., in U.S. Pat. No. 5,857,926. The actual CoR value at 125 ft/sec was derived as follows. Each ball was launched at an initial velocity within the range of 110 to 140 ft/sec. A minimum of five well-spaced velocities within this range were selected. The CoR value at each respective initial velocity was obtained, and a linear function was fit to the data. The linear relationship was then computed at 125 ft/sec to obtain CoR. The square of the residuals, $r^2$, was required to equal or exceed 0.95 for a ball to be deemed suitable. For a usual CoR experiment, an $r^2>0.98$ was typically found. In all, 12 balls for each compound were screened in this manner, averaged, and the results are shown in Table III.

EXAMPLE 8

Golfball cores of 1.520" average diameter were produced by curing in an aluminum mold at 335° F. for 12 minutes. PGA compression was measured using the tensile deflection of a ball in inches at a load of 200 lbs, as taught by Sullivan, et al., in U.S. Pat. No. 5,857,926. It was found in the course of this work that a suitable relationship between PGA compression and tensile deflection could be found by calculating the PGA compression=160−(850*tensile deflection (inches)) at a load of 200 lbs. The twelve balls per compound selected in Example 5 were measured for tensile deflection, PGA compression computed, and the results averaged. The results are shown in Table III.

TABLE III

| Catalyst Terminator | PGA Compression | σ (compression) | CoR (125 ft/sec) | σ(CoR) |
|---|---|---|---|---|
| Ethanol | 69.9 | 2.4 | 0.7938 | .0021 |
| 2-ethylhexanol | 73.3 | 3.2 | 0.7956 | .0024 |
| 1-octadecanol | 75.5 | 3.6 | 0.7954 | .0023 |
| Acetic acid | 72.2 | 4.4 | 0.8037 | .0033 |
| 2-ethylhexanoic acid | 74.6 | 2.5 | 0.8042 | .0025 |
| Octadecanoic acid | 71.6 | 3.9 | 0.7986 | .0020 |
| Abietic acid (control) | 66.6 | 3.2 | .7945 | .0027 |

Novel Terminators

Typically, in the practice of standard Ziegler-Natta polybutadiene polymerization catalysis, abietic acid is used as a catalyst terminator. It has been used with

FIG. 1

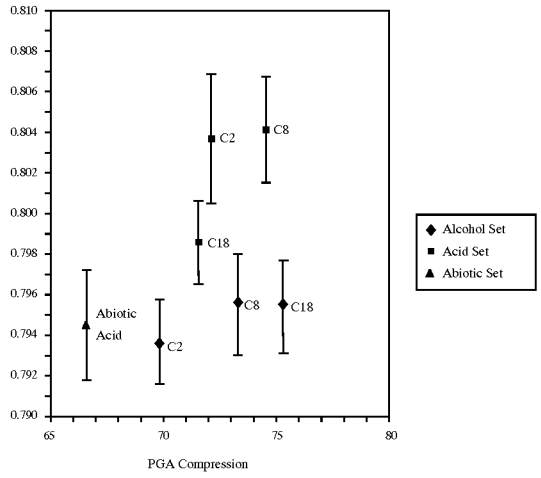

benefit in the application of automotive tire products, as taught by Henderson, et al. in U.S. Pat. No. 4,321,171.

In terms of the critical resilience property, the coefficient of restitution (CoR) at 125 ft/sec, however, golfball cores produced with abietic acid demonstrate values in accordance with many other terminators, seen in Table III and FIG. 1. Typically, higher CoR values demonstrate longer distances when struck by a golf club. It is normally understood by those skilled in the art that CoR values at 125 ft/sec which are higher by 0.005 potentially significant, and by 0.008–0.010 highly significant. The typical statistical standard deviations are in the range of 0.002–0.004 CoR points.

The use of lower-carbon number aliphatic acids from $C_2$ to $C_{11}$, and preferably $C_8$ to $C_{10}$, for the termination of Ziegler-Natta catalysts disclosed herein is substantially different from, and advantageous over, the conventional use of abietic acid for golfball applications. These terminator materials are typically used in the amounts of 1 to 5 molar equivalents with regard to catalyst metal content, preferably in the 1.5 to 3 equivalents range.

First, the higher aliphatic acids from $C_{12}$ and higher, of which abietic acid is a member display CoR at 125 ft/sec values which are not substantially different from one another. Stearic acid (octadecanoic acid) provides a slight improvement with respect to abietic acid. The lower aliphatic acids, $C_2$ through $C_{11}$, provide a substantial CoR increase with regard to abietic acid, providing a highly significant advantage.

Second, these differences are significantly different than many other Ziegler-Natta terminators, such as aliphatic alcohols, that span a large carbon number range. In Table III and FIG. 1, it is demonstrated that the aliphatic lower carbon number acids, provide a qualitative CoR advantage over this class of catalyst terminators.

While certain representative embodiments and details have been shown for the purpose of illustrating the subject invention, it will be apparent to those skilled in this art that various changes and modifications can be made without departing from the scope of the present invention.

What is claimed is:

1. A golf ball which is comprised of a solid core and a resin cover, wherein the solid core is comprised of cis-1,4-polybutadiene rubber which is made by polymerizing 1,3-butadiene in the presence of a Ziegler-Natta catalyst wherein the polymerization is short-stopped with a carboxylic acid of the structural formula RCOOH wherein R represents an alkyl group containing from 1 to about 30 carbon atoms.

2. A golf ball which is comprised of a solid core and a resin cover, wherein the solid core is comprised of cis-1,4-polybutadiene rubber which is made by polymerizing 1,3-butadiene in the presence of a nickel catalyst system wherein the polymerization is short-stopped with a carboxylic acid of the structural formula RCOOH wherein R represents an alkyl group containing from 1 to about 30 carbon atoms.

3. A golf ball as specified in claim 2 wherein R represents an alkyl group containing from 1 to 10 carbon atoms.

4. A golf ball as specified in claim 2 wherein R represents an alkyl group containing from 5 to 10 carbon atoms.

5. A golf ball as specified in claim 2 wherein R represents an alkyl group containing from 7 to 10 carbon atoms.

6. A golf ball as specified in claim 2 wherein the nickel catalyst system is comprised of (a) an organonickel compound, (b) an organoaluminum compound, (c) a fluorine containing compound.

7. A golf ball as specified in claim 6 wherein said nickel catalyst system is further comprised of para-styrenated diphenylamine.

8. A golf ball as specified in claim 6 wherein the organoaluminum compound and the fluorine containing compound are brought together in the presence of the para-styrenated diphenylamine.

9. A golf ball as specified in claim 2 wherein the solid core is further comprised of a co-crosslinking agent and a peroxide.

10. A golf ball as specified in claim 9 wherein the co-crosslinking agent is present at a level which is within the range of about 15 phr to about 60 phr.

11. A golf ball as specified in claim 10 wherein the peroxide is present at a level which is within the range of about 0.5 phr to about 3 phr.

12. A golf ball as specified in claim 10 wherein the peroxide is present at a level which is within the range of about 1 phr to about 2.5 phr.

13. A golf ball as specified in claim 9 wherein the co-crosslinking agent is present at a level which is within the range of about 25 phr to about 40 phr.

14. A golf ball as specified in claim 13 wherein said core is further comprised of a filler.

15. A golf ball as specified in claim 14 wherein said filler is selected from the group consisting of barium sulfate, zinc oxide, calcium carbonate and silica.

16. A golf ball as specified in claim 15 wherein said cis-1,4-polybutadiene has a Mooney ML 1+4 viscosity as measured at 100□C which is within the range of about 30 to about 90.

17. A golf ball as specified in claim 15 wherein said cis-1,4-polybutadiene has a Mooney ML 1+4 viscosity as measured at 100□C which is within the range of about 40 to about 80.

18. A golf ball as specified in claim 15 wherein said cis-1,4-polybutadiene has a Mooney ML 1+4 viscosity as measured at 100□C which is within the range of about 50 to about 75.

19. A golf ball as specified in claim 6 wherein the organonickel compound is nickel octanoate.

20. A golf ball as specified in claim 6 wherein the organoaluminum compound is triisobutyl aluminum.

21. A golf ball as specified in claim 6 wherein the fluorine containing compound is hydrogen fluoride.

22. A golf ball as specified in claim 6 wherein the fluorine containing compound is boron trifluoride.

* * * * *